US005757224A

United States Patent [19]

Antone et al.

[11] Patent Number: 5,757,224

[45] Date of Patent: May 26, 1998

[54] CURRENT MIRROR CORRECTION CIRCUITRY

[75] Inventors: James A. Antone; Brian W. Mann, both of Edwards, Ill.

[73] Assignee: Caterpillar Inc., Peoria, Ill.

[21] Appl. No.: 638,419

[22] Filed: Apr. 26, 1996

[51] Int. Cl.[6] ..... G05F 1/10

[52] U.S. Cl. ..... 327/538; 327/540; 327/545; 323/315; 323/316

[58] Field of Search ..... 327/538, 540, 327/545; 323/313, 315, 316

[56] References Cited

U.S. PATENT DOCUMENTS

| | | | |
|---|---|---|---|
| 4,317,054 | 2/1982 | Caruso et al. | 327/539 |
| 4,570,115 | 2/1986 | Misawa et al. | 323/313 |
| 4,703,249 | 10/1987 | De La Plaza et al. | 323/316 |
| 4,897,595 | 1/1990 | Holle | 323/314 |
| 4,912,347 | 3/1990 | Morris | 327/541 |
| 4,990,845 | 2/1991 | Gord | 323/312 |
| 5,619,163 | 4/1997 | Koo | 327/539 |

*Primary Examiner*—Terry Cunningham
*Attorney, Agent, or Firm*—Mario J. Donato, Jr.

[57] ABSTRACT

The present invention is directed toward a circuit for receiving an input current and for producing an output voltage proportional to the input current. The circuit includes a first transistor which receives the input current, and a second transistor connected to the first transistor, wherein the first and second transistors comprise a current mirror topology. A third transistor is connected in series with the first transistor, and an operational amplifier has an output which is connected to the base of the third transistor. The third transistor has a collector coupled to a base junction of the current mirror. The operational amplifier has a positive input terminal coupled to a collector of the second transistor through a first resistor, and a negative input terminal coupled to an emitter of the third transistor through a second resistor, the first and second resistors having substantially similar impedance values.

8 Claims, 6 Drawing Sheets

PRIOR ART

PRIOR ART

CURRENT MIRROR CORRECTION CIRCUITRY

TECHNICAL FIELD

This invention relates generally to circuitry having a current mirror topology, and more particularly, to current mirror correction circuitry that compensates for the inherent inaccuracies of this circuit as used in this application, and which produces a result which is a more linear voltage output representation of the current.

BACKGROUND ART

The current mirror topology as applied to this circuit has an inherent inaccuracy. Shown in FIG. 1 is a prior art circuit that uses a current mirror topology to measure high current Io and produce a low voltage signal Vo. However, the inherent inaccuracy still exists. In operation, when current flows in the high current circuit labeled Io, it pulls current across the resistor $R_1$ from $V_S$. The result of this circuit, Vo, is supposed to be a voltage output proportional to the current input. However, this is assuming that $Vbe_1$ is equal to $Vbe_2$, which in reality is not the case. The reason $Vbe_1$ and $Vbe_2$ are not equal is because the current going through $Vbe_1$ is nearly constant, while the current going through $Vbe_2$ is varying, thereby causing the voltage in $Vbe_2$ to vary. Thus, we do not have a true current mirror but instead are using the topology to provide a voltage proportional to Io. Because $Vbe_1$ and $Vbe_2$ are not equal, various measurements had to be taken in a laboratory environment at a particular operating current to determine the relationship between the voltage out (Vo) and the current (Io). In other words, it was known that at a certain operating current there would be a certain difference between $Vbe_1$ and $Vbe_2$, which would result in a certain amount of error in Vo, which could then be designed around.

The present invention is directed to overcoming one or more of the problems as set forth above.

SUMMARY OF THE INVENTION

The present invention is directed toward a circuit for receiving an input current and for producing an output voltage proportional to the input current. The circuit includes a first leg which receives the input current, and a second leg connected in parallel with the first leg, wherein the first and second legs comprise a current mirror topology. A third leg is connected in series with the first leg, and includes a transistor and an operational amplifier. The transistor has a collector coupled to a base junction of the current mirror, and the operational amplifier has an output connected to a base of the transistor. The operational amplifier has a positive input terminal coupled to the second leg through a first resistor and a negative input terminal coupled to the transistor through a second resistor. Preferably, the first and second resistors have substantially similar impedance values. The operational amplifier output drives the transistor, causing the voltage across the first resistor to be equal to the voltage across the second resistor, such that the output voltage of the circuit is proportional to the input current to the circuit.

These and other aspects and advantages of the present invention will become apparent upon reading the detailed description of the preferred embodiment in connection with the drawings and appended claims.

BRIEF DESCRIPTION OF THE DRAWINGS

For a better understanding of the present invention, reference may be made to the accompanying drawings, in which.

DESCRIPTION OF A PREFERRED EMBODIMENT OF THE INVENTION

Figure 1:
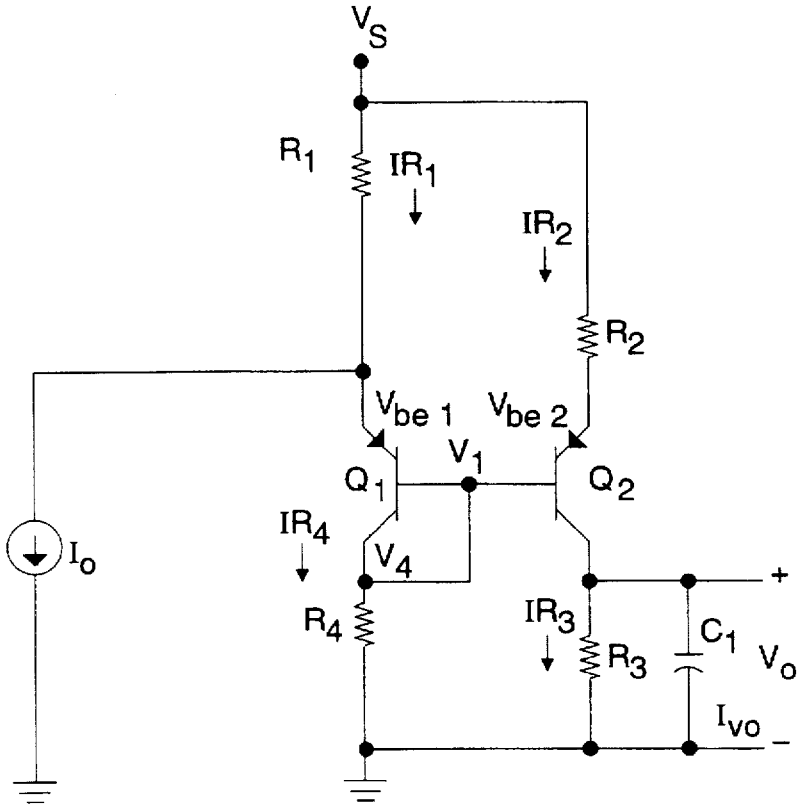
FIG. 1 shows a prior art circuit having a current mirror topology.

As explained above, the current mirror topology circuit of FIG. 1 has inherent inaccuracies. In operation, when current flows in the high current circuit labeled Io, it pulls current across the resistor $R_1$ from $V_s$. The result of this circuit, Vo, is supposed to be a voltage output proportional to the current input. In solving for Vo in the above circuit, we have $$Vo=(IoR_1R_3)/R_2+(Vbe_1-Vbe_2)R_3/R_2$$

If $Vbe_1=Vbe_2$ (traditional assumption), then $$Vo=(IoR_1R_3)/R_2$$

However, in reality, $Vbe_1$ and $Vbe_2$ are not equal. Rather, the $(Vbe_1-Vbe_2)$ offset is dependent on Io. For large Vs and small $R_1$, $Vbe_1$ is nearly constant. However, $Vbe_2$ varies greatly with $IR_2$ and Io.

Figure 2:
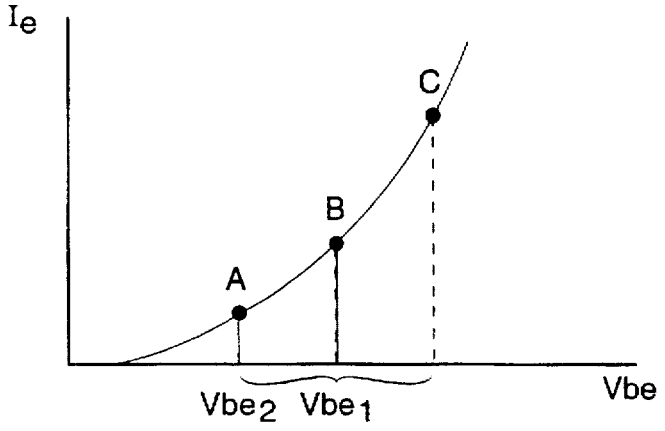
FIG. 2 shows a graph of the current for the emitter (Ie) versus the voltage of the base-emitter junction (Vbe) of FIG. 1.

Referring to FIG. 2, a graphical representation of the current for the emitter (Ie) versus the voltage-base-emitter junction (Vbe) of FIG. 1 is shown. As seen in FIG. 2, $Vbe_1$ is essentially constant at point B because through the nature of the circuit in FIG. 1 (e.g. $R_4$ is much greater than $R_1$), the change across $R_4$ in voltage is generally less than one percent. The current going through $Vbe_1$, therefore, changes very little. However, the current going through $Vbe_2$ varies from near zero current at point A to the maximum current at point C, depending on the scaling, which may be above $Vbe_1$. As the current changes significantly, the voltage, $Vbe_2$, is varying back and forth. The generated offset error is difficult to model and sync out because of the nonlinear relationship.

Figure 4:
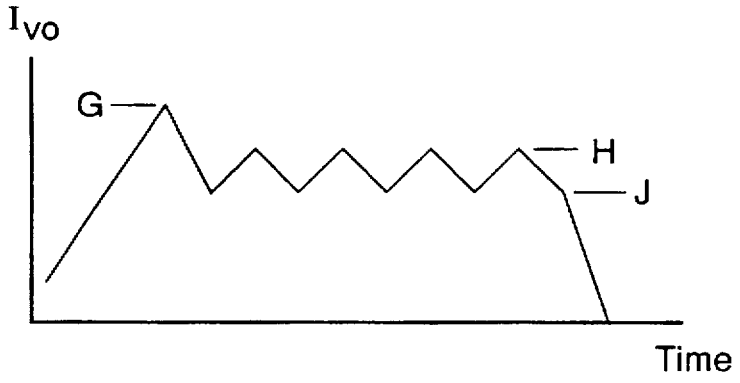
FIG. 4 shows a graph of a typical generated waveform.

For example, one type of fuel injector may be most accurately controlled with a current waveform of the general shape shown in FIG. 4. After the injector is fired, it produces a current, which serves as one example of the Io of the circuit of FIG. 1. The waveform is represented in FIG. 4 having a fixed peak at point G, a minimum at point J, with a roughly chopped signal at point H. When using the current circuit of FIG. 1, only one waveform may be present in a control. If it was needed to design a new current waveform (e.g. different injectors require different amounts of current and therefore different waveforms), a new control was released, with the resistors changed to tune the mirror circuit to the different current waveform. For example, with the circuit of FIG. 1, if a current level corresponding to point G was needed from the control, various measurements had to be taken in a laboratory environment by engineers who took a best guess as to what values they thought would generate "G" amps, measure it, and that would be G amps plus some error due to the offset (e.g. $Vbe_1-Vbe_2$). As described earlier, since $Vbe_1$ and $Vbe_2$ are not equal, various measurements had to be taken at a particular operating current to determine the relationship between the voltage out (Vo) and the current (Io). The offset was dependent on the current, so it was a trial and error basis. Then, to set the J point, the same thing would have to be done again, except the offset was different due to the different set point. Therefore, the control signal had to be "corrected" for the offset for each current level on a trial and error basis.

In certain applications, it is desirable to be able to program the values of the current waveforms. This, however, presents a difficult challenge when using the circuit of FIG. 1, not only because of the trial and error techniques described above, but also because a map needs to be created for each point on the current curve for each of the desired current waveforms. Therefore, there is a need for a circuit that can control the ($Vbe_1-Vbe_2$) offset to be substantially zero.

Figure 3:
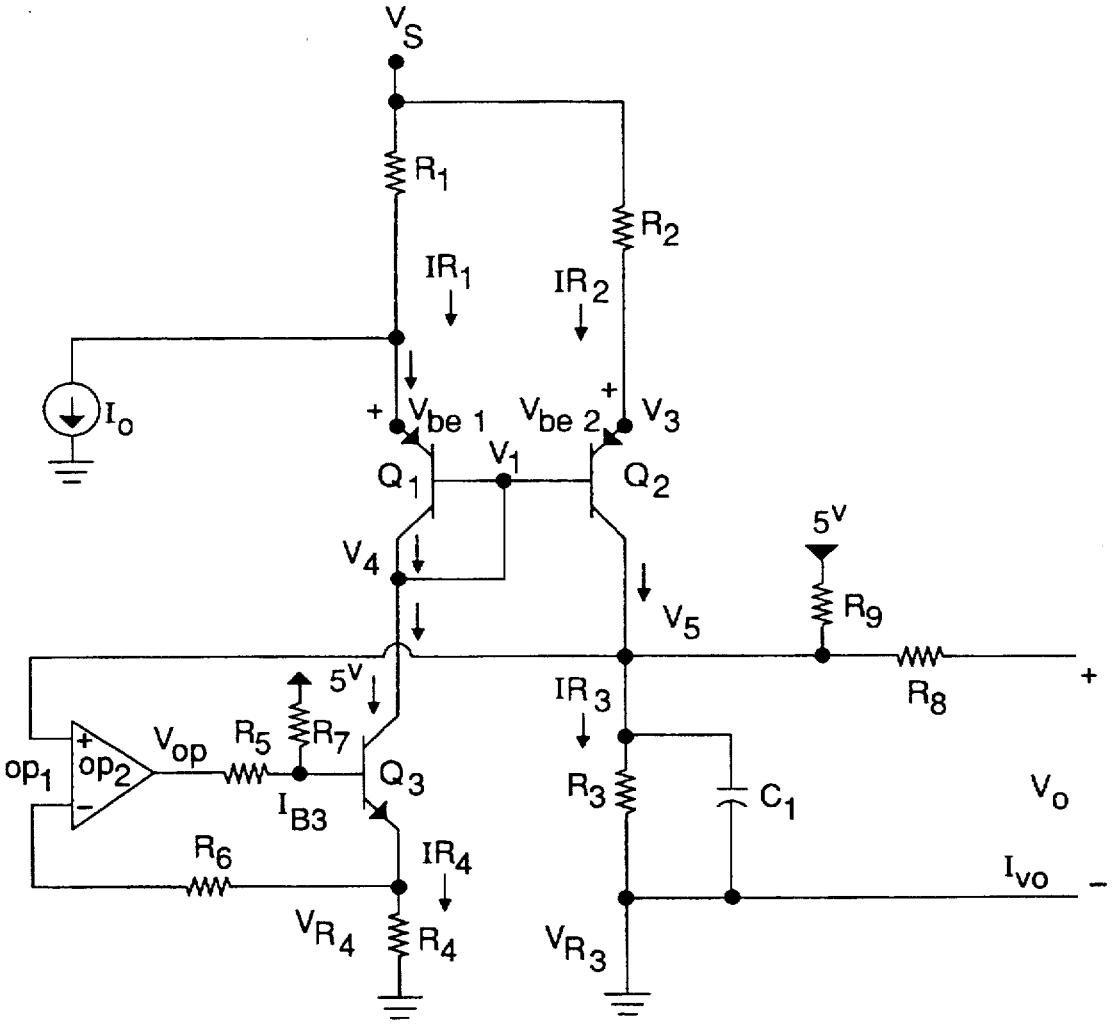
FIG. 3 shows a circuit having a current mirror topology associated with the present invention.

Referring now to FIG. 3, the present invention includes resistors $R_1$, $R_2$, $R_3$, and $R_4$, and transistors $Q_1$, and $Q_2$ with the base junction from $Q_1$ to $Q_2$ connected. Additionally, the $R_4$ leg of the circuit includes a transistor $Q_3$ and an operational amplifier. As seen in FIG. 3, the transistor $Q_3$ is in series with $R_4$, which creates similar current in $Q_1$ and $Q_2$. There is also at least one additional bias resistor, either $R_7$ or $R_9$.

The operation of the circuit shown in FIG. 3 is as follows. There is a normally biased path through $Q_1$ emitter out of the base, tied back to junction $V_4$, down to $Q_3$ collector emitter, and out $R_4$ to ground due to biasing $Q_3$ slightly on with either $R_7$ or $R_9$, which is described in greater detail below. As Io increases, the voltage drop across $R_1$ increases. The $V_{R1}$ change allows less voltage for current down the leg of the circuit with $R_4$, in addition to dropping voltage at base junction point $V_1$. The base voltage operates on $Q_2$ to drop the voltage across $Vbe_2$. In turn, $V_3$ drops proportional to $V_1$, which creates a voltage drop across $R_2$, causing current to flow in that leg of the circuit.

As a result of the foregoing, current flows through $R_2$, through $Q_2$ emitter to collector (note: a small amount flows through the base, which is negligible), and down through $R_3$. The voltage generated across $R_3(V_{R3})$is supplied as the positive input to the op-amp, which is set up in a voltage follower configuration. If the voltage at the positive input terminal is greater than the voltage at the negative input terminal, the output of the op-amp, which provides the base current to $Q_3$, will increase. The voltage drop across $R_4$ is supplied to the negative input terminal of the op-amp. As the voltage across $R_3$ increases and is supplied to the positive input terminal of the op-amp, it increases the output of the op-amp. The increased output from the op-amp increases the current to the $Q_3$ base, which in turn causes the current through $Q_3$ emitter and collector to increase proportionally. The increase in current through $Q_3$ causes the voltage across $R_4$ to rise until it is equal to what is at the positive input terminal of the op-amp. It should be noted that $C_1$ is used in combination with all resistance at node $V_5$, thereby creating a filter. In addition, $R_5$ is used to protect the base of transistor $Q_3$ from excessive current.

As a result of the foregoing, if $R_3$ is equal to $R_4$, then $R_3$ and $R_4$ tend to have the same voltage drop value, and thus the same current value. The current source for $R_4$ and $Q_3$ comes from $Q_1$ and the current source for $R_3$ comes from $Q_2$. Therefore, by controllably forcing the currents in $R_3$ and $R_4$ to be equal, the current through the emitters of $Q_1$ and $Q_2$ are equal, assuming that the base currents are negligible.

In the preferred embodiment, $R_3$ is equal to $R_4$. Since the op-amp drives transistor $Q_3$ to make sure the voltage across $R_3$ is equal to the voltage across $R_4$, the current in both $Vbe_1$ and $Vbe_2$ will be the same (minus the Vos of the op-amp and resistor tolerances). Therefore, the offset ($Vbe_1-Vbe_2$) described above goes to substantially zero. Consequently, the voltage output Vo is truly proportional to the current input Io.

Figure 5:
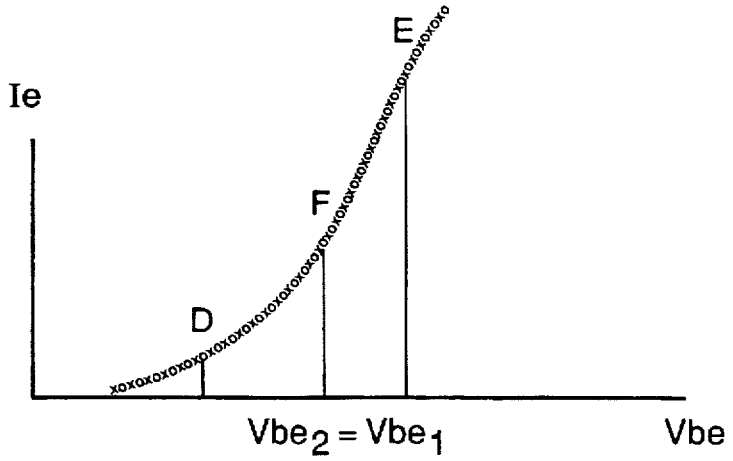
FIG. 5 shows a graph of the current for the emitter (Ie) versus the voltage of the base-emitter junction (Vbe) of FIG. 3.

For example, referring to FIG. 5, $Vbe_2$ and $Vbe_1$ are of equal value, wherein both $Vbe_1$ and $Vbe_2$ are essentially constant. Therefore, $Vbe_2$ and $Vbe_1$ are essentially tracked between points D and E, and in this case are at the same point on the graph. Therefore, because the offset ($Vbe_1-Vbe_2$) is substantially zero, the current output Io is truly proportional to the voltage output Vo.

Referring again to FIG. 3, when the current in the mirror is zero with no "load" applied, the opamp goes to the negative rail, particularly if it is not a high-precision rail-to-rail op-amp because the voltage across $R_1$ is zero. This in turn shuts off the $Q_3$ transistor which is undesirable because when the load is applied, there is no current bias applied to the $Q_1/Q_2$ current mirror pair transistors. The current threshold that the $Q_1/Q_2$ mirror actually gets "kicked" on is dependent on having a noise transient at $V_5$ which will turn on $Q_3$ and begin the current to voltage tracking. This indeterminate level is undesirable because it is so unpredictable.

Because the circuit does not have a readily guaranteed known turn-on current, but rather depends on the parasitics of the circuit to induce $V_5$ to go high momentarily, it has been determined that a forced offset to ensure the mirror is always biased slightly on at all times is beneficial so that the output can track to almost zero load current. In one embodiment, to accomplish this, resistor $R_7$ is included so that even if the op-amp saturates at the negative rail which can be at 0.2 volts or lower, the $R_5/R_7$ resistors set up a voltage divider that sets the base of $Q_3$ at about 0.7 volts or higher to ensure that $Q_3$ is always slightly on. This ensures that both $Q_1$ and $Q_2$ are always slightly on and will track once the threshold is met.

Figure 6:
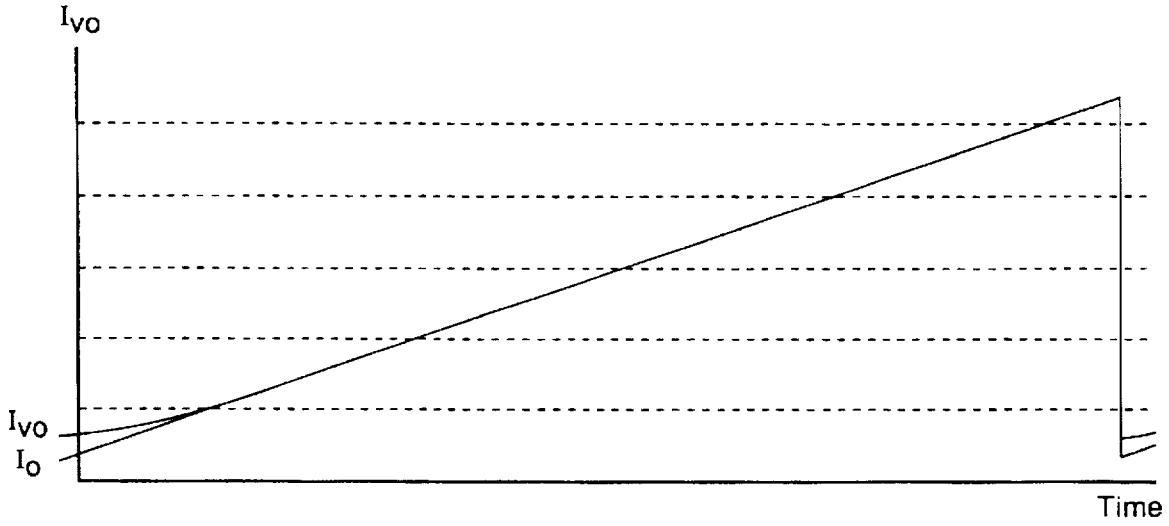
FIG. 6 shows a graph of the current tracking the voltage once an initial bias level is exceeded.

Referring now to FIG. 6, the voltage out Vo is a minimal voltage even with zero current applied. However, as current in the load increases, once it exceeds the initial bias level, then the voltage tracks the current as described earlier. The point at which this circuit begins to track is somewhat variable depending on the bias level and the transistor used for $Q_3$. For example, if Iin is less than or equal to the bias threshold, the output voltage is a minimal voltage; if Iin is greater than the bias threshold, the output voltage "tracks" the input current. However, it has been determined that for applications in which current levels exceeding 1 amp need to be controlled, the implementation including resistor $R_7$ easily meets that requirement.

As described above, it has been determined that a forced offset to ensure the mirror is always biased slightly on at all times is beneficial so that the output can track to almost zero load current. In an alternate embodiment, resistor $R_9$ is utilized to allow the circuit to read as near zero current as possible, while overcoming the somewhat variable nature of the curve shown in FIG. 6 in light of the bias level. Referring to FIG. 3, $R_9$ is included to provide the offset rather than $R_7$. As such, an offset, which is merely a voltage divider between $R_3$ and $R_9$, is input to the $V_5$ junction, which is input to the op-amp. Therefore, as long as the offset exceeds the offset voltage of the op-amp, it is possible to read down to that output level or above. Further, it allows the current mirror to be always biased slightly on.

Figure 7:
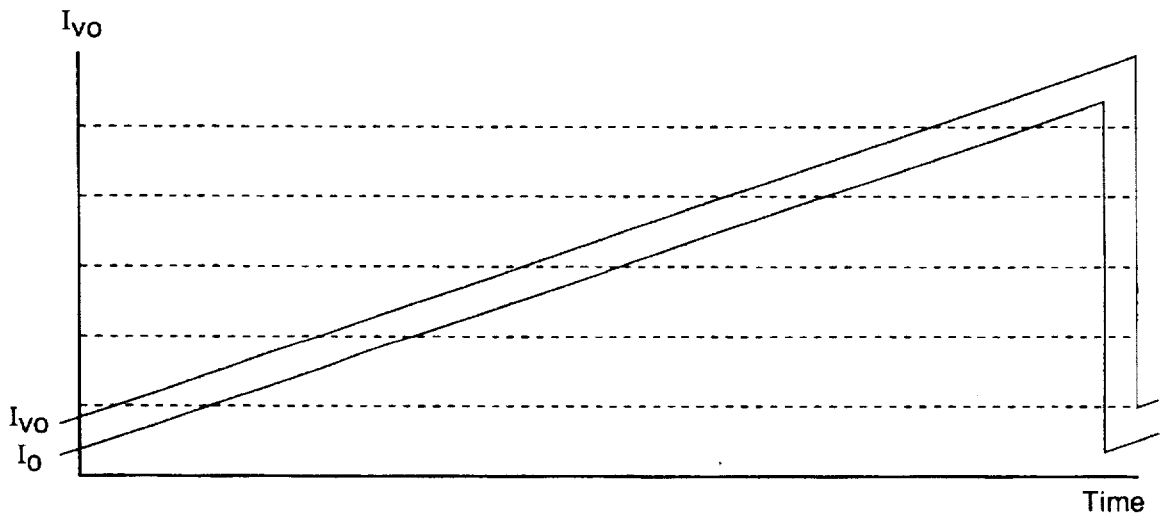
FIG. 7 shows a graph of the current tracking the voltage wherein a known offset is added to the $V_5$ junction.

Referring to FIG. 7, the voltage out Vo is a minimal voltage even with zero current applied. However, the voltage tracks the current almost immediately as described earlier. For example, as Iin goes from near zero to Imax, the output voltage tracks the input current plus the slight offset. This offset can then be subtracted by the next stage either by software or by hardware, or if within the tolerance of the application, the offset may be neglected altogether. Therefore, virtually any load can be controlled down to virtually zero current.

Industrial Applicability

Circuits with a current mirror topology are well known in the art and generally provide an output current that is a function of the current in to the circuit. One application in which a circuit with a current mirror topology is utilized is the firing of a fuel injector. Fuel injectors are well known in the art and provide a way to introduce fuel into the cylinders of an engine. Fuel injectors often provide more flexibility in terms of timing and other performance considerations than a carburetor or other means for introducing fuel into the cylinders. Typically, fuel injectors include an actuating solenoid that allows fuel flow to the fuel injector when the solenoid is energized. Fuel is then typically injected into the engine cylinder as a function of the time period during which the solenoid remains energized. Fuel flow is typically terminated when the solenoid is no longer energized.

Accurate control of both the timing and quantity of fuel injected is important to engine performance and emissions. To accurately control fuel injection, it is important to know the relationship between the time when electrical current is applied to the fuel injector solenoid and the time when fuel begins to be injected. Likewise the relationship between terminating the electrical current to the solenoid and the time when fuel flow to the cylinder is terminated must be known. Those relationships, and the specific current waveforms that most accurately control the opening and closing of the fuel injector vary from one model or type of fuel injector to another. For example, one type of fuel injector may be most accurately controlled with a current waveform of the general shape shown in FIG. 4 of the present application, while a second type of injector may be more accurately controlled with a current waveform of a different general shape.

In prior art current waveform controls, a specific control circuit is designed for each specific desired current waveform. Thus, if an engine manufacturer uses several different fuel injectors across its product line, the manufacturer typically is required to have a specific current waveform control circuit for each fuel injector. This results in the additional expense of having to design several current waveform control circuits, the expense of having to inventory separate parts for each circuit, and the expense of having to maintain an inventory of all the different circuit boards.

In certain applications, it is advantageous to utilize a circuit that uses a current mirror topology to measure high current and produce a low voltage signal, wherein the current is proportional to the voltage. For example, when a fuel injector is fired, it is advantageous to take the current output from the injector and generate a voltage proportional to that current, which may then be used in producing the current waveform control. In addition, in machine control applications, it is advantageous to be able to read as near zero current as possible, such as when controlling valves on an engine. Further, in certain applications, it is desirable to be able to program the current values of waveforms. This, however, presents a difficult challenge when using the circuit of FIG. 1, not only because of the trial and error techniques described above, but also because a map needs to be created for each point on the current curve for each of the desired current waveforms.

The present invention provides a circuit wherein the offset ($Vbe_1$–$Vbe_2$) term goes to substantially zero. Consequently, the voltage output Vo is truly proportional to the current input Io. Io is a control signal that has a pulse value, a peak current value, a small current value, and a need to be modulated in a certain band. By being able to vary those reference levels, the Io is controlled. Therefore, the present invention virtually eliminates the Vbe error and allows software control of the reference levels of the Io.

Thus, while the present invention has been particularly shown and described with reference to the preferred embodiment above, it will be understood by those skilled in the art that various additional embodiments may be contemplated without departing from the spirit and scope of the present invention.

We claim:

1. A circuit for receiving an input current and for producing an output voltage proportional to the input current, comprising:

a current mirror including a first transistor for receiving the input current at an emitter thereof and a second transistor having a base coupled to a base of said first transistor;

a third transistor connected in series with said first transistor and to ground, said third transistor being a conductive type reverse to that of said first and second transistors and having a collector coupled to a base junction of said first and second transistors; and an operational amplifier having an output connected to a based of said third transistor, said operational amplifier having a positive input terminal coupled to a collector of said second transistor and to ground through a first resistor, said operational amplifier having a negative input terminal coupled to an emitter of said third transistor through a second resistor, said first and second resistors having substantially similar impedance values;

whereby said operational amplifier output drives said third transistor, causing the voltage across said first resistor to be equal to the voltage across said second resistor, such that the output voltage of the circuit is proportional to the input current to the circuit.

2. A circuit as recited in claim 1, including means for biasing said current mirror on at substantially all times.

3. A circuit as recited in claim 2, wherein said means for biasing comprises a pull-up resistor connected to said third transistor.

4. A circuit as recited in claim 3, including a capacitor connected in parallel with said first resistor, thereby forming a filter.

5. A circuit for receiving an input current and for producing an output voltage proportional to the input current, comprising:

an input stage, said input stage providing input current to the circuit;

a first leg, said first leg receiving said input current;

a second leg connected to said first leg, said first and second legs comprising a current mirror including a first transistor and a second transistor, said second transistor having a base coupled to a base of said first transistor;

a third leg connected in series with said first leg, said third leg including a third transistor and an operational amplifier, said third transistor having a collector coupled to a base junction of said current mirror, said operational amplifier having an output connected to a based of said third transistor, said operational amplifier having a positive input terminal coupled to said second leg and to ground through a first resistor, said operational amplifier having a negative input terminal coupled to said third transistor through a second resistor, said first and second resistors having substantially similar impedance values; and an output stage, said output stage producing an output voltage of the circuit;

whereby said operational amplifier output drives said transistor, causing the voltage across said first resistor to be equal to the voltage across said second resistor, such that the output voltage of the circuit is proportional to the input current to the circuit.

6. A circuit as recited in claim 5, including means for biasing said current mirror on at substantially all times.

7. A circuit as recited in claim 6, wherein said means for biasing comprises a pull-up resistor connected to said transistor.

8. A circuit as recited in claim 7, including a capacitor connected in parallel with said first resistor.

* * * * *